US010516927B2

(12) United States Patent
McElveen et al.

(10) Patent No.: US 10,516,927 B2
(45) Date of Patent: Dec. 24, 2019

(54) ACOUSTIC PARABOLIC MIRROR RING APPARATUS

(71) Applicant: Wave Sciences, LLC, Charleston, SC (US)

(72) Inventors: James Keith McElveen, Charleston, SC (US); Noah I. Schiffman, Charleston, SC (US)

(73) Assignee: Wave Sciences, LLC, Charleston, SC (US)

( * ) Notice: Subject to any disclaimer, the term of this patent is extended or adjusted under 35 U.S.C. 154(b) by 0 days.

(21) Appl. No.: 15/955,147

(22) Filed: Apr. 17, 2018

(65) Prior Publication Data

US 2019/0320254 A1 Oct. 17, 2019

(51) Int. Cl.

| | |
|---|---|
| ***H04R 1/08*** | (2006.01) |
| ***H04R 1/34*** | (2006.01) |
| ***H04R 1/40*** | (2006.01) |

(52) U.S. Cl.
CPC ..... *H04R 1/08* (2013.01); *H04R 1/342* (2013.01); *H04R 1/406* (2013.01)

(58) Field of Classification Search
CPC ..... H04R 1/08; H04R 1/406; H04R 1/342
See application file for complete search history.

(56) References Cited

U.S. PATENT DOCUMENTS 6,285,772 B1 * 9/2001 Tate ..... H04R 1/406 379/433.03

* cited by examiner

*Primary Examiner* — Brian Ensey
(74) *Attorney, Agent, or Firm* — Gregory Finch; Finch Paolino, LLC

(57) ABSTRACT

An apparatus for enhancing microphone performance of a voice-controlled smart home device is disclosed. The apparatus generally comprises a lower ring having a first diameter an upper ring having a second diameter and a reflective surface. The reflective surface is disposed along the perimeter of the apparatus so as to directionally alter incoming sound waves and focus them toward an array of microphones.

15 Claims, 6 Drawing Sheets

ACOUSTIC PARABOLIC MIRROR RING APPARATUS

FIELD

The present disclosure relates generally to acoustic amplification and more particularly to an amplification apparatus for use with a portable interactive system which may be wireless.

BACKGROUND

Wireless entertainment systems employ microphones and processing equipment that provides wireless connectivity to the Internet. The systems operate as front-ends for web services such as streaming audio, music, books, video and other content. The most advanced of these devices receive voice commands whereby the user asks for certain content that will be played over the entertainment system. The audio signal is digitized by the system and translated over a network as a request for a certain service. In addition, numerous other voice activated and voice controlled electronic devices exist in the market that employ microphones and processing equipment for their functionality; for example, smart home technology, audio/video teleconferencing equipment, and the like.

In order to function optimally, an entertainment system such as the one described above must receive clear audio instruction from a user. This may prove difficult in situations where a system is placed in a location where extraneous sounds interfere with the user commands. Additionally, the system may be placed in a relatively noise free space but in a position where the sound waves from the user cannot be received by the microphones of the entertainment system. In order to overcome this many systems include an array of microphones arranged, for example, in a circular pattern. These systems, however, often include the array of microphones in a direction that is orthogonal to the incoming sound waves.

Various electronic noise cancelling and modulation devices have been proposed to enhance the quality of the sound waves received from the user. These systems, however, require a separate power source and are rather expensive given the complex hardware and software systems that are employed to achieve the desired result. An inexpensive and less complex system is desirable. Through applied effort, ingenuity, and innovation, Applicant has identified a number of deficiencies and problems with microphone performance in voice controlled consumer electronic devices. Applicant has developed a solution that is embodied by the present invention, which is described in detail below.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An apparatus for enhancing microphone performance of a voice-controlled smart home device is disclosed. The apparatus generally comprises a lower ring having a first diameter and defining a lower circumference, an upper ring having a second diameter and defining an upper circumference, and a reflective surface defining an outer area extending from the lower ring to the upper ring, the outer area defining a paraboloidal circumference. The reflective surface is selectively disposed along the perimeter of the apparatus so as to directionally alter incoming sound waves and focus them toward an array of microphones located on the voice-controlled smart home device.

The apparatus is designed to fit over the top of a home entertainment device. In order to facilitate this one or more connectors may be disposed around the outer perimeter of the lower ring shaped structure. The one or more connectors is configured to selectively secure the lower ring to a surface of a home entertainment device proximal to an array of microphones located on the smart home device.

In an alternative embodiment, the reflective surface is a unitary body extending about the diameter of the lower and upper ring. The diameter of the lower ring is less than the diameter of the second ring. The reflective surface may be curved outwardly between the lower ring and the upper ring so as to form a parabolic shape. As sound, in particular a voice command from a user, is directed toward the home entertainment system it is directed toward the one or more microphones of the entertainment system. In another embodiment, the diameter of the upper and lower rings are the same. The two rings are connected by and spaced apart by a wall. The height of the wall is optimized to intercept voice commands from a wide array of angles. The reflective surface comprises interspersed tabs that extend from the top of the upper ring. The tabs may be curved or simply extend at an angle. Each tab corresponds to and is located in proximity to a microphone of the interactive home entertainment device.

The foregoing has outlined rather broadly the more pertinent and important features of the device so that the detailed description that follows may be better understood. Additional features will be described hereinafter which form the subject of the claims of the invention. It should be appreciated by those skilled in the art that the conception and the disclosed specific methods and structures may be readily utilized as a basis for modifying or designing other structures for carrying out the same purposes of the device. It should be realized by those skilled in the art that such equivalent structures do not depart from the spirit and scope of the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1A:
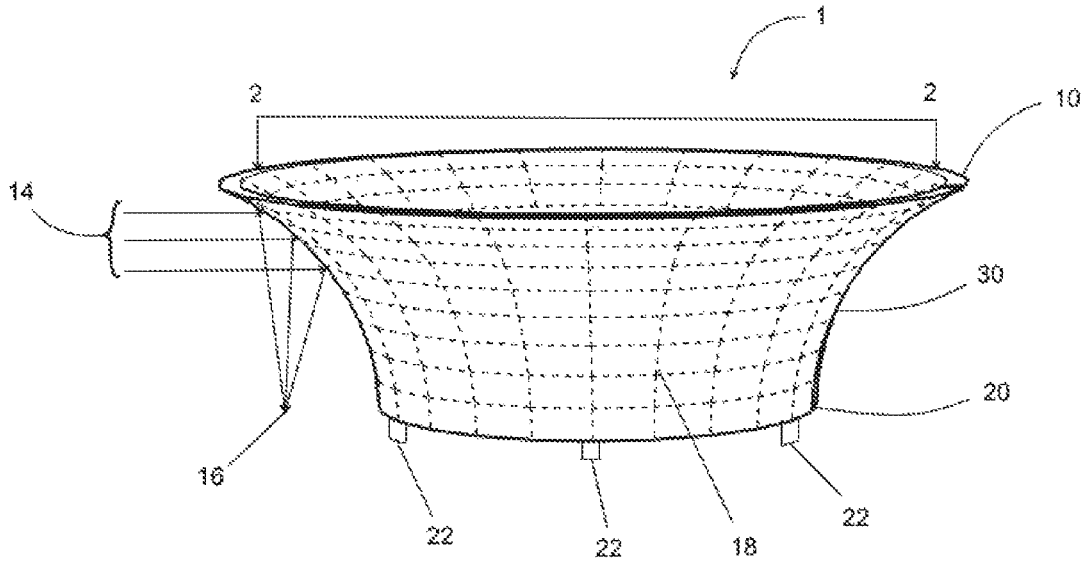
FIG. 1*a* is a side view of the acoustic enhancing apparatus, according to an embodiment.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

FIGS. 1-5 illustrate an apparatus for enhancing microphone performance 1. The apparatus 1 comprises a lower ring 20 and upper ring 10 and a reflective surface 30. The lower ring may include a plurality of attachment tabs 22 extending from its lower surface. The apparatus 1 may be selectively coupled to a surface of a home entertainment device such as the one shown in FIG. 5. According to an embodiment, in order to facilitate selective coupling to the surface of the home entertainment device, the connectors 22 are disposed around the outer perimeter of lower ring 20. The one or more connectors 22 are configured to bend outward as they contact the upper surface of an interactive home entertainment system or voice-controlled electronic device 40. Alternatively, apparatus 1 may be friction-fit to a surface or circumference of voice-controlled electronic device 40 at a location proximal to one or more microphones located on or within voice-controlled electronic device 40. According to an embodiment, reflecting surface 30 is configured to have a parabolic focal point proximal to the one or more microphones located on or within voice-controlled electronic device 40.

Ring 10 and 20 are described as being annular for purposes of illustration only. Ring 10 and 20 may instead comprise a box like structure (not shown in the drawings) that corresponds to the general shape of the smart device upon which the apparatus 1 will be deployed. According to various embodiments of the present disclosure, lower ring 20 defines a lower diameter and circumference; upper ring 10 defines an upper diameter and circumference; and, reflective surface 30 defines an outer area extending between lower ring 20 and upper ring 10 to define a paraboloidal circumference. Lower ring 20, the upper ring 10, and reflective surface 30 may be configured to define a toroidal shape. According to an embodiment, the diameter of lower ring 20 is less than the diameter of upper ring 10. For example and further according to an embodiment, the diameter of lower ring 20 may be configured in the range of about 80 to about 90 millimeters; and, the diameter of upper ring 10 may be configured in the range of about 90 to about 120 millimeters. The diameter of upper ring 10 may be configured to extend outside the dimensions of the electronic device to which it is attached.

Figure 1B:
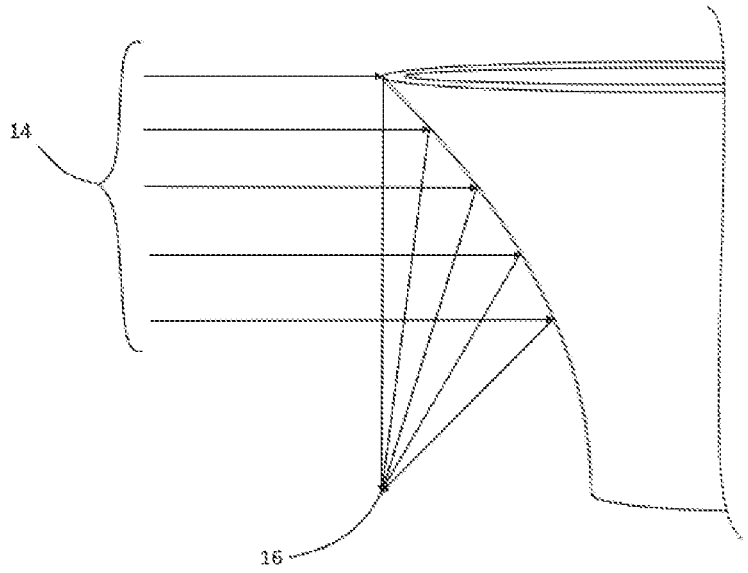
FIG. 1*b* is a diagram of a parabolic focal point of the acoustic enhancing apparatus, according to an embodiment.

The reflective wall may include at least one orientation indicator 18 or a plurality of indicators as shown in FIG. 1. The indicators corresponding to the location of one or more microphones on a voice-controlled smart home device 40, shown in FIG. 5. In certain embodiment the indicators serve the function of aligning the reflective surface or tabs 34, described in greater detail below, with the microphones 42 of the smart device 40.

As shown in FIG. 1*a*, upper ring 10 and the lower ring 20 both have different diameters. In particular, upper ring 10 has a greater diameter than lower ring 20. The reflective surface 30 is disposed between the two rings 10, 20 having varied diameters such that the reflective surface is curved outward forming a parabaloid, toroidal, parabolic-like shape. As sound waves 14 are broadcast toward the apparatus 1 they interact with the reflective surface 30 and are re-focused 16 in a desired direction.

Figure 2:
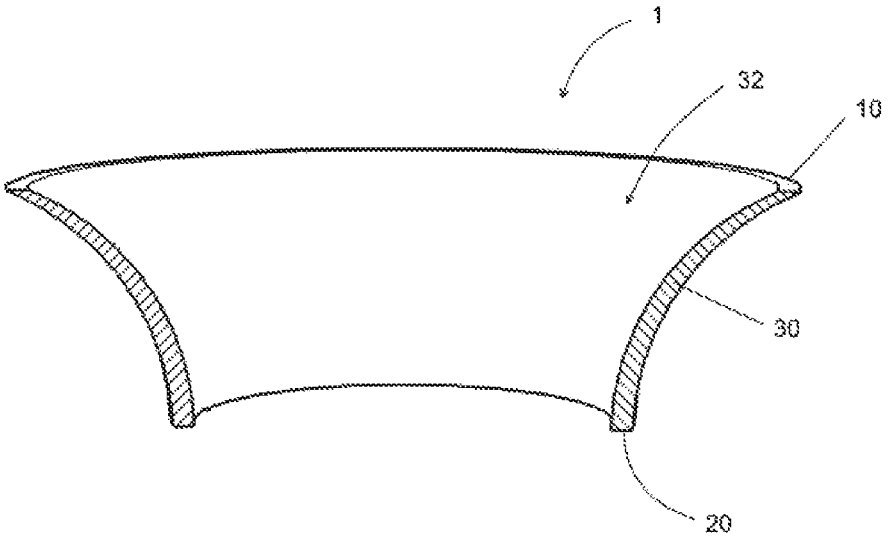
FIG. 2 is a sectional view taken along line 2-2 of FIG. 1*a*, according to an embodiment.
Figure 3:
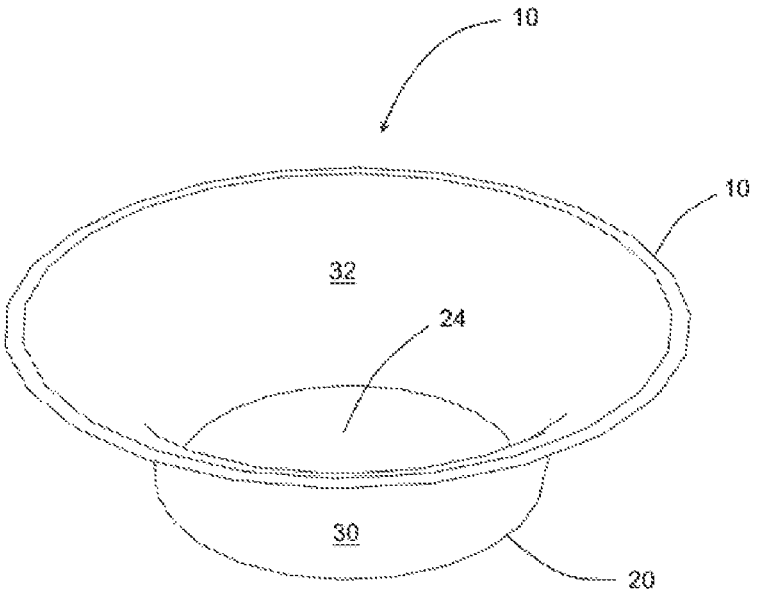
FIG. 3 is a top perspective view of the acoustic enhancing apparatus, according to an embodiment.
Figure 4:
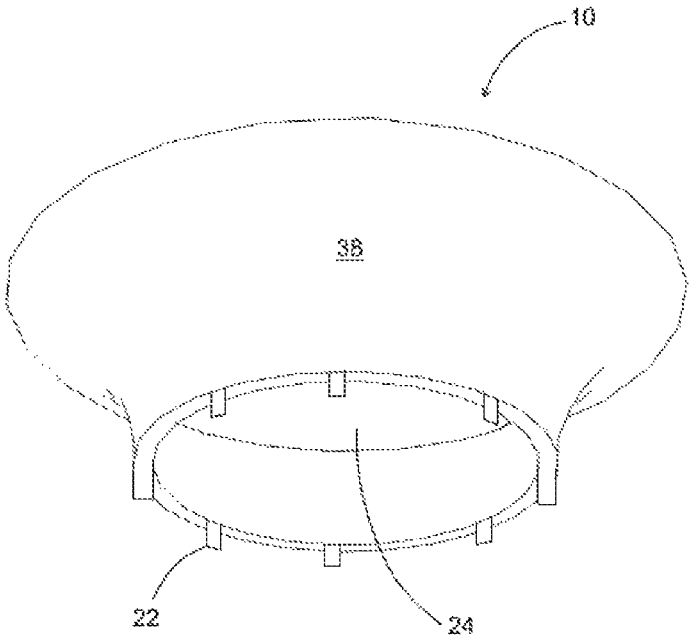
FIG. 4 is a bottom perspective view of the acoustic enhancing apparatus, according to an embodiment; and, FIG. 5 is a side view showing the position of the acoustic enhancing apparatus prior to being mounted atop an interactive entertainment system, according to an embodiment.

As shown in FIGS. 1-5 the reflective surface 30 is a unitary body extending between the upper 10 and lower 20 ring. Lower ring 20 includes and annular opening 24 as does upper ring 10. This allows sound from the speaker system of the smart device to travel through the apparatus 1 unimpeded so as to not be muffled. As shown in FIG. 2, the reflective surface has a solid inner surface 32.

Figure 5:
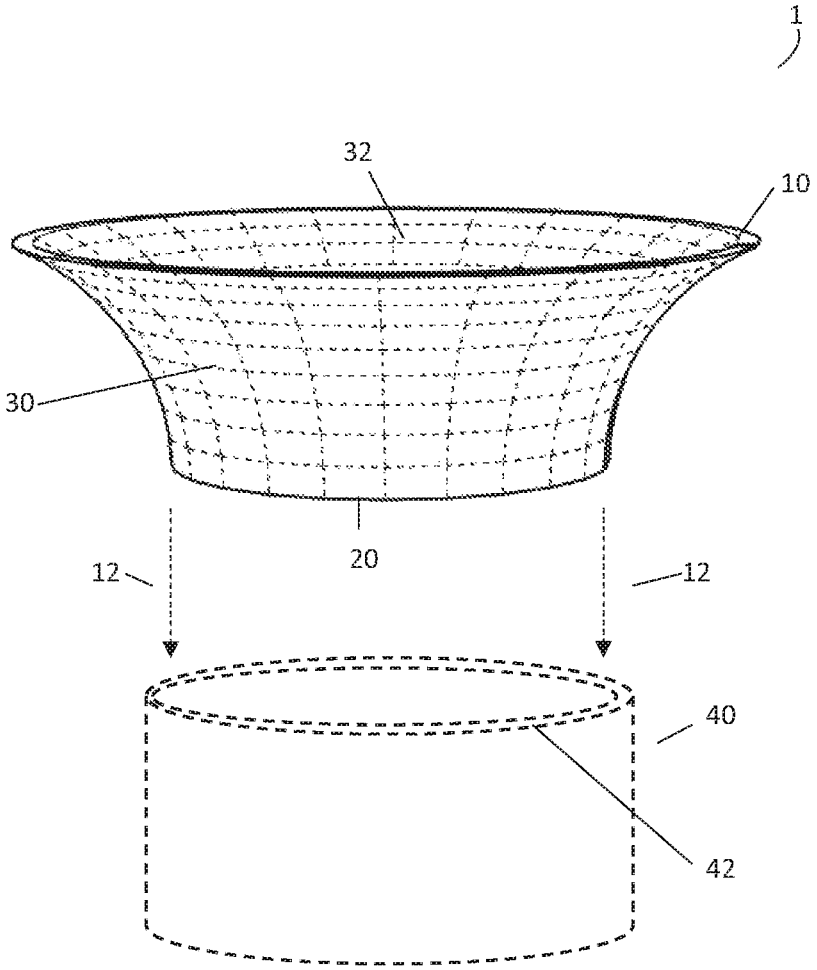

With reference to FIGS. 1*a* and 5, the operation of the apparatus 1 will be demonstrational. Apparatus 1 is selectively coupled to the upper surface of a smart device 40 having a plurality of microphones 42 located along its upper periphery. The apparatus is lowered in the direction of arrows 12 to fit atop the smart device 40. Once atop the device 40 the reflective surface 30 interacts with incoming sound waves 14 to alter them in a direction 16 that is optimal for reception by microphones 42. It will be appreciated that the apparatus 1 may be tuned by varying the diameter of upper ring 10 relative to lower ring 20 so as to change the parabolic shape and focal point of the reflective surface 30.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. An apparatus for enhancing microphone performance of a voice-controlled smart home device, the apparatus comprising:

a lower ring having a first diameter and defining a lower circumference;

an upper ring having a second diameter and defining an upper circumference; and, a reflective surface defining an outer area extending from the lower ring to the upper ring, the outer area defining an upward opening paraboloidal circumference.

2. The apparatus of claim 1 wherein the lower ring is configured to be selectively coupled to a surface or circumference of a voice-enabled electronic device.

3. The apparatus of claim 1 wherein the lower ring, the upper ring, and the reflective surface define a toroidal shape.

4. The apparatus of claim 1 wherein the first diameter is less than the second diameter.

5. The apparatus of claim 2 wherein the reflective surface is configured to have a parabolic focal point proximal to an array of microphones located on said voice-enabled electronic device.

6. The apparatus of claim 2 wherein the second diameter is greater than a diameter of said voice-enabled electronic device.

7. The apparatus of claim 1 further comprising one or more connectors disposed around the lower ring, the one or more connectors being configured to selectively secure the lower ring to a surface of a voice-enabled electronic device.

8. The apparatus of claim 1 wherein the reflecting surface is configured to be selectively positioned proximal to an array of microphones located on said voice-enabled electronic device.

9. The apparatus of claim 1 wherein the first diameter is in the range of about 80 to about 90 millimeters.

10. The apparatus of claim 1 wherein the second diameter is in the range of about 90 to about 120 millimeters.

11. An apparatus for enhancing microphone performance of a voice-controlled smart home device, the apparatus comprising:

at least one ring-shaped structure defining a circumference;

a plurality of acoustic reflecting structures disposed on an upper surface of the at least one ring-shaped structure, each acoustic reflecting structure in the plurality of acoustic reflecting structures comprising a concave interior portion extending along an x-axis and y-axis from an upper surface of the at least one ring-shaped structure to define a parabolic curve, the concave interior portion being oriented adjacent to an outer perimeter of the at least one ring-shaped structure; and, at least one orientation indicator disposed on the at least one ring-shaped structure, the at least one orientation indicator corresponding to the location of one or more microphones on a voice-controlled smart home device.

12. The apparatus of claim 11 wherein each acoustic reflecting structure in the plurality of acoustic reflecting structures has a height in the range of about 15 millimeters to about 25 millimeters.

13. The apparatus of claim 11 further comprising further comprising one or more connectors disposed around the outer perimeter of the at least one ring-shaped structure, the one or more connectors being configured to selectively secure the at least one ring-shaped structure to a surface of a home entertainment device proximal to an array of microphones located on said smart home device.

14. An apparatus for enhancing microphone performance of a voice-controlled smart home device, the apparatus comprising:

a lower ring having a first diameter and defining a lower circumference;

an upper ring having a second diameter and defining an upper circumference; and, a reflective surface defining an outer area extending from the lower ring to the upper ring, the outer area defining a paraboloidal circumference, wherein the reflective surface is configured to have a parabolic focal point adjacent to the lower ring.

15. The apparatus of claim 14 wherein the first diameter is less than the second diameter.

* * * * *